US005829203A

United States Patent [19]

Ealer, Sr.

[11] Patent Number: 5,829,203

[45] Date of Patent: Nov. 3, 1998

[54] ROOF SAFETY BRACKET

[76] Inventor: James Edward Ealer, Sr., 150 Hwy. WW, St. Clair, Mo. 63077

[21] Appl. No.: 773,685

[22] Filed: Dec. 24, 1996

[51] Int. Cl.[6] ..... E04G 3/08

[52] U.S. Cl. ..... 52/37; 52/741.1; 182/45; 248/237

[58] Field of Search ..... 52/24, 26, 37, 52/741.1; 182/3, 45; 248/237

[56] References Cited

U.S. PATENT DOCUMENTS

| | | | |
|---|---|---|---|
| 4,141,182 | 2/1979 | McMullen | 52/24 |
| 4,249,713 | 2/1981 | Glynn et al. | 248/237 |
| 4,830,341 | 5/1989 | Arteau et al. | 52/37 X |
| 4,946,123 | 8/1990 | Albert | 248/237 |
| 5,287,944 | 2/1994 | Woodyard | 182/45 X |
| 5,361,558 | 11/1994 | Thornton et al. | 248/237 X |

FOREIGN PATENT DOCUMENTS

| | | | |
|---|---|---|---|
| 2384918 | 11/1978 | France | 182/45 |

OTHER PUBLICATIONS

DBI/SALA Canada, Inc., "User Instruction Manual for L3672 Roof Anchor," 1993, pp. 1–6.

Qual–Craft, "Instructions for Model #5100 Roof Edge and #5200 Roof Peak Anchors," 1994, p. 1.

DBI/SALA, "L3670 & L3671 Roof Anchors," undated, pp. 1–4, admitted prior art.

Swing Stage Supply, Inc., Roofmaster Products Co., "For carpenters—the roof decking can be put on and the FALL-STOP™ bracket left for the roofers," undated, p. 1, admitted prior art.

*Primary Examiner*—Christopher Kent
*Assistant Examiner*—Timothy B. Kang
*Attorney, Agent, or Firm*—Senniger, Powers, Leavitt & Roedel

[57] ABSTRACT

A bracket for use in attaching a safety fall arrest system to a roof having rafters. Each rafter has an upper surface comprising a central portion extending along the length of the rafter and two edge margins on opposite sides of the central portion. The central portion defines a fastening zone into which one or more fasteners may be driven to attach the bracket to the roof. Each edge margin defines a non-fastening zone into which one or more fasteners should not be driven. Each non-fastening zone has a relatively narrow width in a direction transverse to the upper surface of the rafter. The bracket has at least one fastening hole for receiving the fastener for fixedly attaching the bracket to one of the rafters, and at least two pilot holes located on opposite sides of the fastening hole. The pilot holes are sized for receiving locating members and positioned such that the locating members can be inserted into the pilot holes without contacting the rafter when the bracket is placed on the upper surface of the rafter with the fastening hole positioned over the fastening zone of the rafter.

7 Claims, 4 Drawing Sheets

ROOF SAFETY BRACKET

This application is based on provisional U.S. application Ser. No. 60/009,400 which is incorporated herein by reference.

BACKGROUND OF THE INVENTION

This invention relates generally to roof safety devices for roof workers, and more specifically to a bracket used to attach a safety device to a roof.

Generally, brackets used to attach a safety device to a roof are placed directly on rafters or plywood over the rafters and secured in place by fasteners. These brackets are typically too large to fit underneath shingles, thus the brackets cannot be used on a shingled roof unless a portion of the shingles is removed. Removal and reinstallment of the shingles require a significant amount of time and creates additional holes in the roof which must be caulked to prevent leakage.

Moreover, if the bracket is to be attached to rafters located beneath plywood, it is difficult to determine the exact location of the rafter to ensure that the bracket is securely fastened to a central portion of the rafter rather than to an edge margin which will not provide sufficient support for the fastener connecting the bracket to the rafter. If the fastener is driven into the edge margin of the rafter the bracket may appear to be securely installed, but there is a risk it will later pull away from the roof when high loads are exerted on the bracket.

Furthermore, the brackets are generally designed for placement along a ridge at the top of the roof and cannot be positioned at various locations across the roof.

Accordingly, there is presently a need for a roof safety bracket which can be attached to a roof having shingles installed, which can be properly positioned over a rafter such that fasteners for attaching the bracket to the rafter are securely inserted into a central portion of the rafter, and which can be positioned at virtually any location on the roof.

SUMMARY OF THE INVENTION

Among the several objects of the invention may be noted the provision of a roof safety bracket which can be attached to a shingled roof without removing any shingles; the provision of a roof safety bracket which is capable of being properly positioned over a rafter even if plywood is covering the rafter, so that fasteners connecting the bracket to the rafter are inserted into a central part of the rafter to provide adequate support for the fastener; the provision of a roof safety bracket which can be attached to a rafter at almost any location on a roof; the provision of a roof safety bracket which can be used more than one time; the provision of a roof safety bracket which is lightweight and compact so that it can fit under a shingle and be carried in a roof worker's tool pouch; and the provision of a roof safety bracket which is economical and easy to manufacture.

Generally, a bracket of the present invention is for use in attaching a safety fall arrest system to a roof having rafters, each of which has a central portion extending along the length of the rafter and defining a fastening zone into which one or more fasteners may be driven to attach the bracket to the roof, and two edge margins on opposite sides of the central portion. The edge margins define non-fastening zones into which the fasteners should not be driven. Each non-fastening zone has a relatively narrow width in a direction transverse to the upper surface of the rafter. The bracket has at least a first fastening hole for receiving the fastener for fixedly attaching the bracket to one of the rafters, and at least two pilot holes located on opposite sides of the fastening hole. The pilot holes are sized for receiving locating members and are positioned such that the locating members can be inserted into the pilot holes without contacting the rafter when the bracket is placed on the upper surface of the rafter with the fastening hole positioned over the fastening zone of the rafter.

In another aspect of the invention, the bracket is used for attaching a safety fall arrest system to a roof having rafters and shingles disposed over the rafters. The bracket includes a first part having at least one fastening hole for receiving a fastener for insertion into the rafter and a second part for attaching the safety fall arrest system to the bracket. The bracket is bent along a bend line separating the first part from the second part of the bracket and extending generally transversely with respect to a central longitudinal axis of the bracket so that when the bracket is placed on the roof the first part of the bracket lays flat against the roof and the second part of the bracket angles upward from the first part of the bracket. The first part of the bracket is configured such that it can fit underneath one of the shingles without requiring removal of the shingle from the roof so that the bracket can be attached to the roof after the shingles have been installed.

In yet another aspect of the invention, the bracket includes a first part having at least one fastening hole for receiving a fastener for attaching the bracket to one of the rafters of the roof and a second part located adjacent to the first part and having an opening formed therein near one end of the bracket. The bracket is bent along a bend line separating the first part from the second part of the bracket and extending generally transversely with respect to a central longitudinal axis of the bracket so that when the bracket is placed on the roof the first part of the bracket lays flat against the roof and the second part of the bracket angles upward from the first part of the bracket. The opening is sized for receiving a safety ring adapted for attachment of the safety fall arrest system to the bracket.

The present invention also involves a method of connecting the bracket described above to a roof having rafters, shingles and a roof sheet interposed between the rafters and shingles. The method includes the steps of a) lifting a shingle and sliding the bracket under the shingle and over the roof sheet in the vicinity of one of the rafters; b) using the first pilot hole to drive the locating member through the roof sheet; c) if the locating member contacts the rafter when it is driven through the roof sheet, removing the locating member from the roof sheet, moving the bracket in a first direction transverse to the rafter, and repeating step (b); d) repeating step (c) until the locating member does not contact the rafter when it is driven through the roof sheet; e) using the second pilot hole to drive a locating member through the roof sheet; f) if the locating member contacts the rafter when it is driven through the roof sheet, removing the locating member from the roof sheet, moving the bracket transversely with respect to the rafter in a second direction generally opposite the first direction, and repeating step (e); g) repeating step (f) until the locating member does not contact the rafter when it is driven through the roof sheet; and h) using one or more fastening holes to drive said one or more fasteners through the roof sheet and into the rafter to securely attach the bracket to the roof.

Other objects and features will be in part apparent and in part pointed out hereinafter.

BRIEF DESCRIPTION OF THE DRAWINGS

Corresponding parts are designated by corresponding reference numerals in the several views of the drawings.

DETAILED DESCRIPTION OF THE PREFERRED EMBODIMENT

Figure 1:
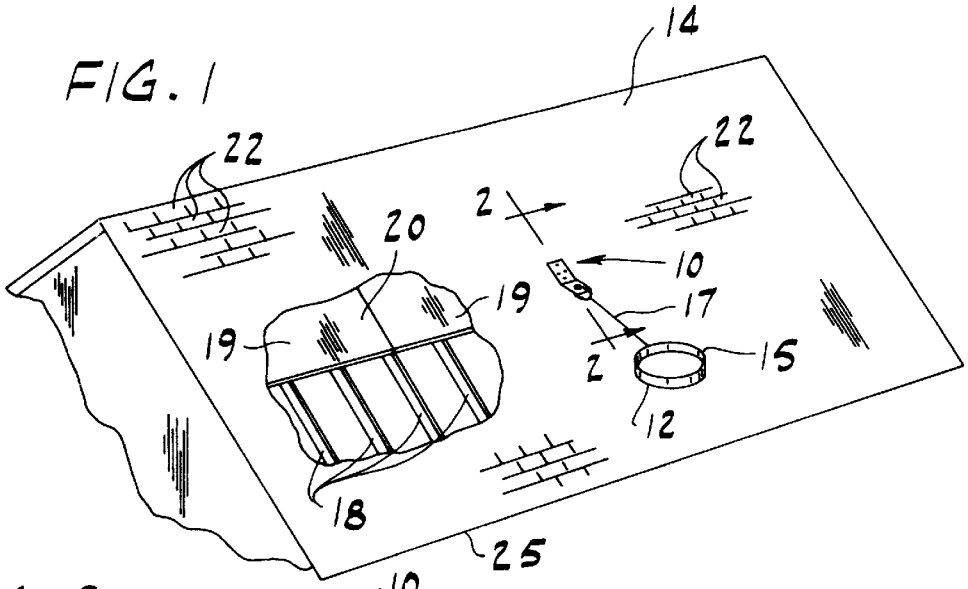
FIG. 1 is a perspective view of a roof safety device attached to a roof by a safety bracket of this invention, parts of the roof being broken away to show several rafters.
Figure 2:
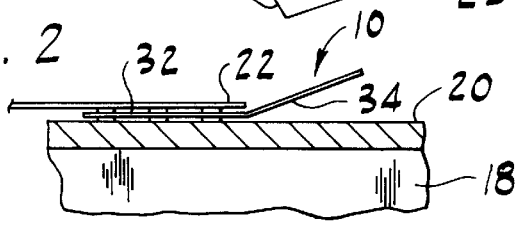
FIG. 2 is a cross-sectional view taken along line 2—2 of FIG. 1 with fasteners removed.

Referring now to the drawings, and first to FIG. 1, there is generally indicated at 10 a roof safety bracket of this invention for attaching a safety fall arrest system 12 to a roof 14. The safety fall arrest system 12 is a conventional body harness system designed to meet applicable OSHA, federal and ANSI requirements. The safety fall arrest system is preferably capable of arresting a worker's fall with a maximum arresting force of up to 900 lbs. and limiting the free fall distance to six feet or less. As shown in FIG. 1, the safety fall arrest system 12 includes a body harness 15, energy absorbing safety line 17 energy and a safety ring 16 for attachment to the bracket 10. The bracket 10 may be sized to support one safety fall arrest system 12 or two or more systems for supporting two or more people. It is to be understood that the bracket 10 may be used with other types of safety fall arrest systems without departing from the scope of this invention.

The bracket 10 may be attached to various types of roofs 14 which include at least one structural load carrying member for supporting the bracket 10 and maximum load force required by the safety fall arrest system 12. The bracket 10 may be used on a house under construction having only a roof frame and rafters 18 or may be used on a finished roof having shingles 22 installed. The bracket 10 may be located anywhere along the length of the roof but preferably at least six feet from any roof edge 25. Support structure at the point of attachment of the bracket is preferably capable of supporting a five thousand pound static load.

FIG. 1 shows a conventional wood frame roof structure having rafters 18, a roof sheet 20 made up of sections of plywood 19 overlying the rafters, and shingles 22 overlying the roof sheet. Each rafter 18 has an upper surface 24 comprising a central portion 26 extending along the length of the rafter and two edge margins 28 on opposite sides of the central portion (FIG. 7). The central portion 26 defines a fastening zone into which one or more fasteners 30 may be driven to attach the bracket 10 to the roof. Each edge margin 28 defines a non-fastening zone into which the fasteners 30 should not be driven because there is insufficient area for adequately supporting fasteners connecting the bracket 10 to the rafter 18. Each non-fastening zone 28 has a relatively narrow width in a direction transverse to the upper surface 24 of the rafter 18 (e.g., 0.25 inch on an 1.50 inch wide rafter). Thus, it is important that the bracket 10 be properly positioned over the rafter 18 so that the fasteners 30 are driven into the fastening zone 26 of the rafter, rather than a non-fastening zone 28, to ensure adequate support for the fasteners.

Figure 4:
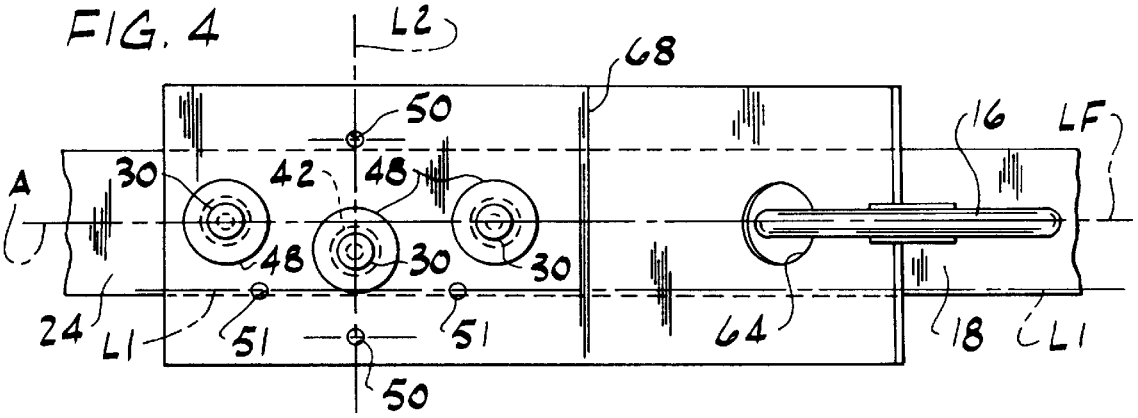
FIG. 4 is a top view of the roof safety bracket of FIG. 3.

The bracket 10 is generally rectangular and comprises a first fastening part 32 and a second safety system attachment part 34. The first part 32 of the bracket 10 includes at least one fastening hole 36 for receiving a fastener 30 for attaching the bracket to the rafter 18. As shown in FIG. 4, first and second fastening holes 36 are located along a generally straight line $L_F$ extending parallel to a central longitudinal axis A of the bracket 10. A third fastening hole 36 is located between the first and second holes and is offset from the line $L_F$. This arrangement of the fasteners prevents splitting of the wood of the rafter 18 along the grain of the wood which is common when fasteners are aligned close together in a straight line. The fasteners 30 are preferably three-inch cement coated nails or two-inch no. 10 stainless steel screws. Other types and sizes of fasteners which meet the appropriate load requirements may also be used.

Figure 3:
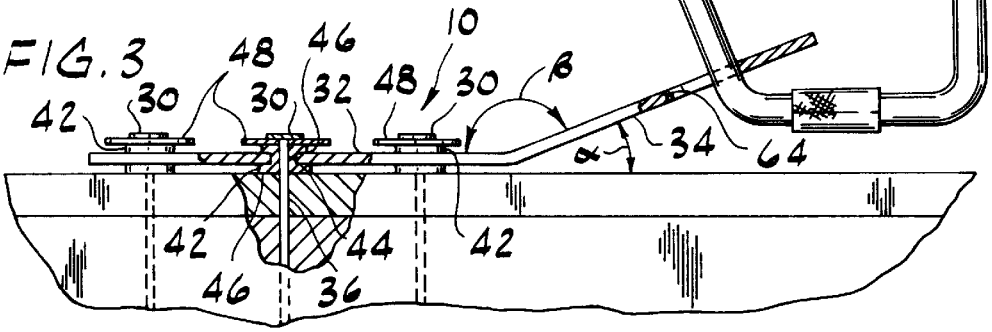
FIG. 3 is a side view of the roof safety bracket of FIG. 1 attached to a rafter, and a safety ring of the safety device.

Rubber grommets 42 are preferably inserted into the fastening holes 36 to absorb shock from impact loads and reduce the load requirement of the bracket 10 and fasteners 30. The grommets 42 also prevent the fasteners 30 from shearing off when a sudden load is applied to the bracket 10. Each grommet 42 comprises a tubular central part 44 sized to have an inside diameter approximately the same as the diameter of the fastener 30 and an outside diameter slightly smaller than the diameter of the fastening hole 36, and flanges 46 on opposite ends of the central part for holding the grommet in place on the bracket 10 (FIG. 3). Grommets of other materials and having other configurations may also be used. Washers 48 made from steel or other suitable material may be placed over the grommet 42 to prevent the bracket 10 from pulling away from the roof 14 and over the fasteners 30. The washers 48 also prevent damage to the surface of the bracket 10 from the fasteners 30, thus increasing the life of the bracket. The fasteners 30, grommets 42 and washers 48 are to be used only one time and replaced each time the bracket 10 is removed and reinstalled.

It is to be understood that the number and location of fastening holes 36 and type of fasteners 30, grommets 42 and washers 48 may vary without departing from the scope of this invention.

The bracket 10 has at least two pilot holes 50 sized for receiving locating members 60 and positioned such that the locating members can be inserted into the pilot holes without contacting the rafter 18 when the bracket is placed on the upper surface 24 of the rafter with the fastening holes 36 positioned over the fastening zone 26 of the rafter. The locating members 60 may be nails, screws or any other suitable device which can be driven through the roof sheet 20 and shingles 22 if required. The pilot holes 50 allow the installer to determine whether the bracket 10 is positioned with the fastening holes 36 located over the fastening zone 26 of the rafter 18 when he cannot see the rafter due to the roof sheet covering the rafter. The pilot holes 50 are spaced apart a distance greater than one half the width of the rafter 18 and less than a distance equal to the width of the rafter minus the width of one edge margin 28 (or non-fastening zone) of the rafter from the fastening hole 36. For example, for a bracket 10 for use with a rafter 18 having a width of 1.5 inches, the first pilot hole 50 may be located 0.875 inches from the center fastening hole 36, and the second pilot hole may be located 1.125 inches from the center fastening hole.

Figure 7C:
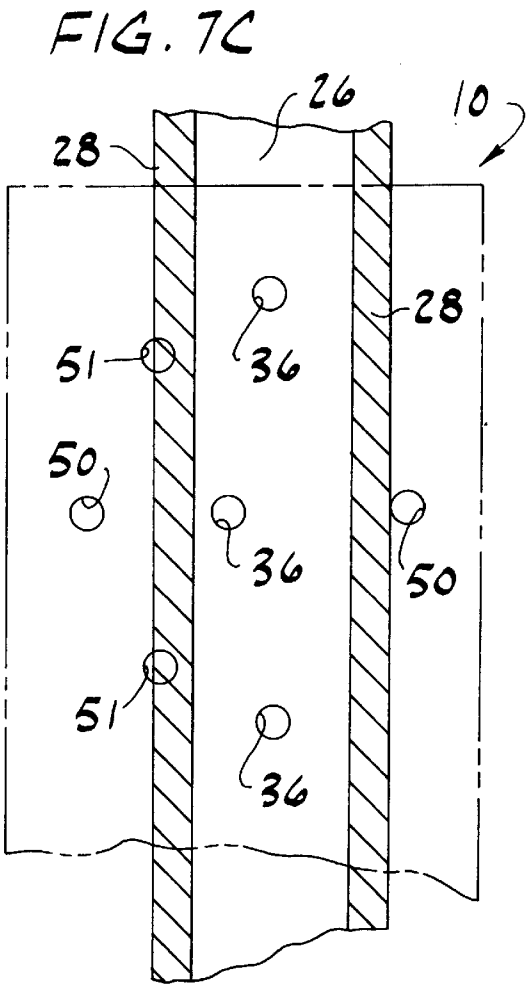
FIG. 7A–E are top views of the roof safety bracket of FIG. 1 showing the bracket in different positions relative to a rafter.
Figure 7B:
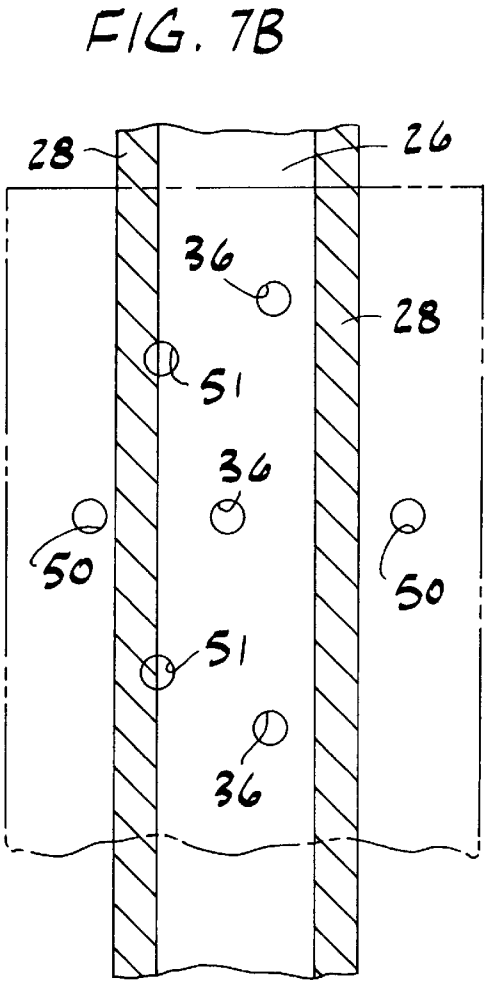
Figure 7A:
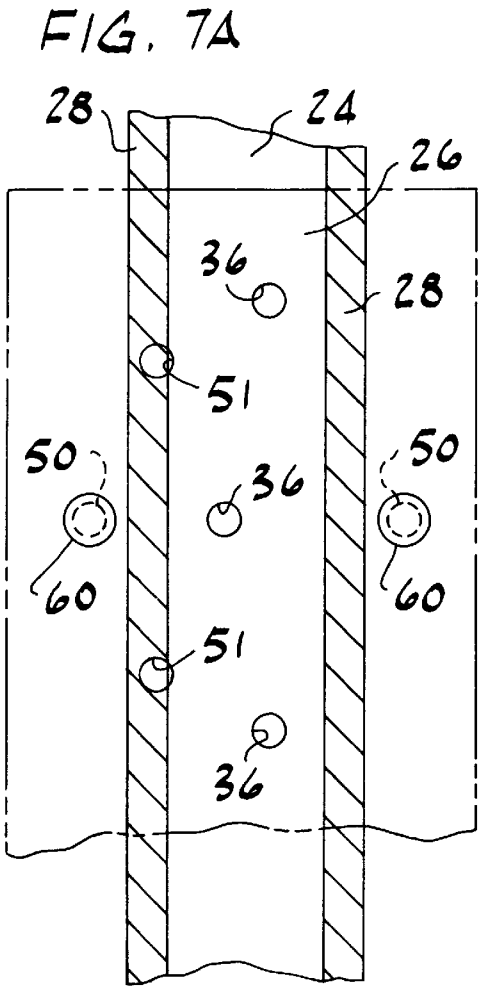
Figure 7E:
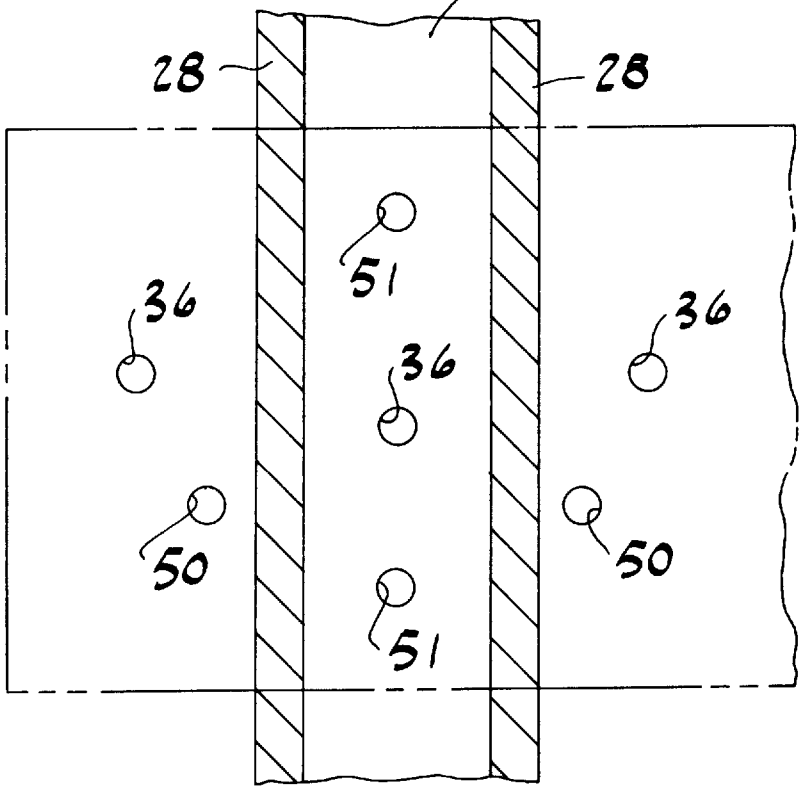
Figure 7D:
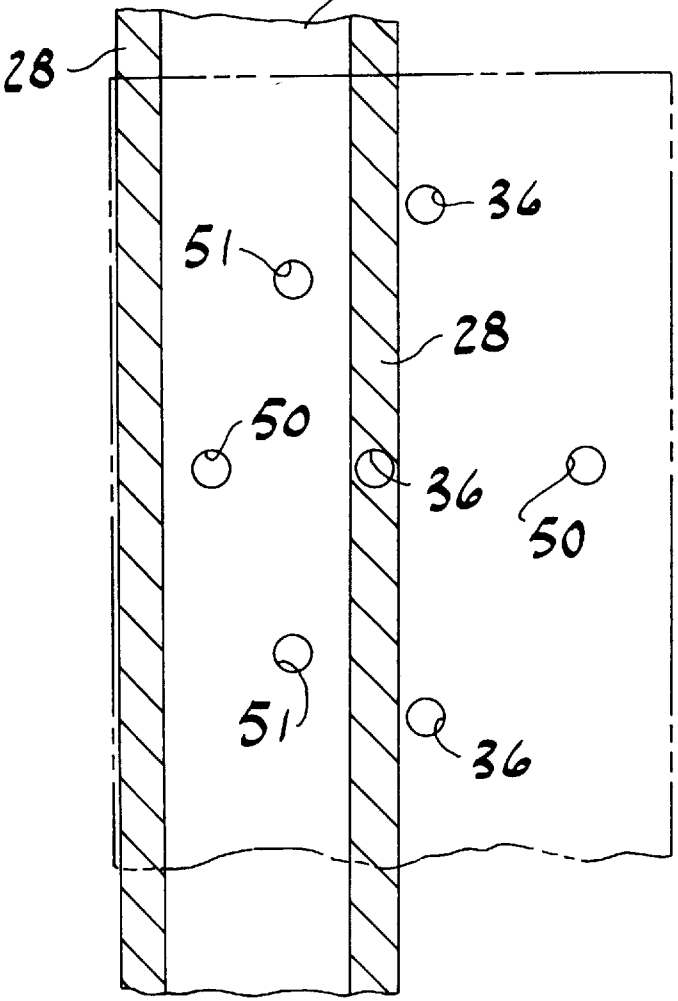

FIGS. 7A–7E show the bracket 10 located in various positions relative to the rafter 18. The portions of the rafter 18 shown cross-hatched correspond to the non-fastening zones 28 of the rafter. In FIG. 7A, the fastening holes 36 of the bracket 10 are located generally over the center of the rafter 18; in FIG. 7B the bracket is positioned with the fastening holes located as far right as possible while still being positioned over the fastening zone 26 of the rafter; and in FIG. 7C the bracket is positioned with the fastening holes located as far left over the fastening zone as possible. FIG. 7D shows the bracket 10 improperly positioned with a fastening hole 36 located over a non-fastening zone 28 of the rafter 18. With the bracket 10 in the positions shown in FIGS. 7A–7C a locating member 60 can be inserted into either the first or second pilot hole 50 without contacting the rafter 18. With the bracket positioned as shown in FIG. 7D, a locating member 60 inserted into the pilot hole 50 on the left will contact the rafter 18 and the roof worker will know the bracket is not properly positioned relative to the rafter. FIG. 7E shows the bracket 10 positioned with its central longitudinal axis A extending transversely to the rafter 18. In this position third and fourth pilot holes 51 are used to properly locate the fastening hole 36 on the rafter 18. The pilot holes 50, 51 thus provide a simple way to determine if the bracket 10 is positioned so that the fasteners will be installed into the fastening zone 26 of the rafter.

As illustrated in FIG. 4, the the third and fourth pilot holes 51 are located along a first line $L_1$ generally parallel to the longitudinal axis A of the bracket. The first and second pilot holes 50 are located along a second line $L_2$ generally perpendicular to the first line $L_1$ for positioning the bracket 10 with the second line extending longitudinally with respect to the rafter 18. The four pilot holes 50, 51 allow the bracket 10 to be installed with either the central longitudinal axis A extending along the length of the rafter 18 or perpendicular to the rafter. This is illustrated in FIGS. 7A–7C where the bracket 10 is oriented so that the three fastening holes 36 are located along the central portion of the rafter 26, and in FIG. 7E where the bracket is turned 90 degrees so that only the center fastening hole is located over the central portion of the bracket. When the bracket 10 is positioned with its longitudinal axis transverse to the rafter 18, the third and fourth pilot holes 51 are used to position the center fastening hole 36 over the central portion 26 of the rafter.

Figure 5:
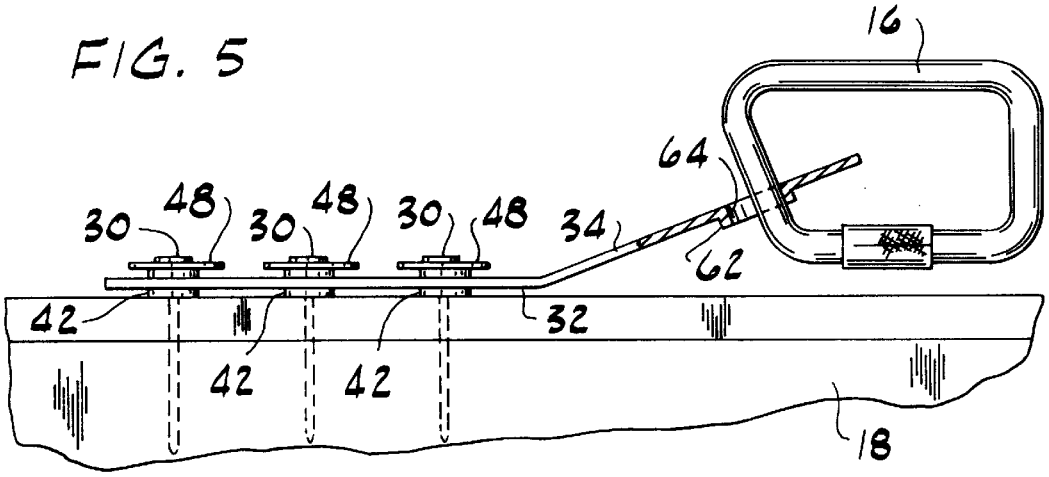
FIG. 5 is a side view of the roof safety bracket of FIG. 1 showing a different configuration of an opening for receiving the safety ring.

The safety system attachment part 36 of the bracket 10 has an opening 64 configured for receiving the safety ring 16 for attaching the safety line 17 of the safety arrest system 12 to the bracket. The opening 64 is located far enough away from an edge of the bracket to provide enough material between the opening and end of the bracket to satisfy the load carrying requirements of the bracket, but close enough to the edge to allow a standard size locking safety ring 16 to be connected to the opening. The opening 64 may also be formed with a peripheral reinforcing flange 62 extending down from the opening to provide increased strength (FIG. 5).

The bracket 10 is bent along a bend line 68 extending generally transversely with respect to the central longitudinal axis A of the bracket 10 so that when the bracket is placed on the roof 14 the first fastening part 32 of the bracket lays flat against the roof and the second attachment part 34 of the bracket angles upward from the first part of the bracket. The bracket 10 may be formed flat and field bent as required during installation on the roof 14, or it may be made initially with a bend formed in the bracket. The bend angle $\alpha$ may vary to allow for adequate spacing between the bracket 10 and the roof 14 so that the safety ring 16 can be attached to the opening 64 in the second part 34 of the bracket. As shown in FIG. 3, bend angle $\alpha$ is substantially less than 90 degrees and complementary angle $\beta$ is substantially greater than 90 degrees.

The bracket 10 is preferably formed from steel and has a width of approximately 3.0 inches, a length of approximately 8.0 inches and a thickness of approximately 0.0625 inches, for example. This compact size allows the bracket 10 to be carried in a roof worker's tool pouch. The first fastening part 32 of the bracket 10 has a length of approximately 4.5 inches which permits the first part of the bracket to be slid under a shingle 22 without removing the shingle. It is to be understood that the bracket 10 may have different shapes or sizes or be made from different materials without departing from the scope of this invention. The bracket 10 may also be used more than once. However, the bracket should be inspected prior to each use for signs of fatigue or wear. If any defects are noted the bracket 10 should be discarded.

Figure 6:
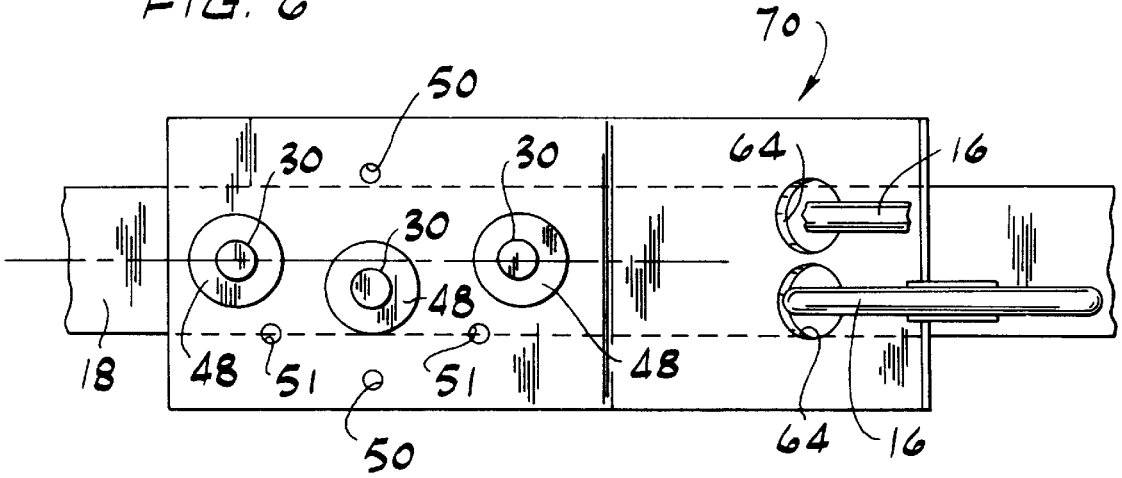
FIG. 6 is a top view of a second embodiment of a roof safety bracket of this invention attached to the rafter, and the safety ring.

A second embodiment of the safety roof bracket, generally indicated at 70, is shown in FIG. 6 and includes two openings 64 for supporting two separate safety fall arrest systems for two roof workers. Additional fastening holes 36 may be added to increase the load carrying capacity of the bracket. The bracket 10 may also be sized to support more than two fall arrest systems.

A method of this invention includes identifying a general area corresponding to the location of a rafter 18, lifting one of the shingles 22 in this area, and sliding the fastening part 32 of the bracket 10 under the shingle and over the roof sheet 20 in the vicinity of the rafter. Using the first pilot hole 50 as a guide, a locating member 60 (e.g., a nail) is then driven through the roof sheet. If resistance is felt sufficient to indicate that the locating member is in contact with the rafter 18, the locating member is removed from the roof sheet and the bracket 10 moved a relatively short distance in a first direction transversely with respect to the rafter. When the bracket has been repositioned, the first pilot hole 50 is again used to drive the locating member 60 through the roof sheet. This process is repeated until there is no resistance from the rafter.

Using the second pilot hole 50 as a guide, the locating member 60 is then inserted into the second pilot hole 50. If resistance is felt indicating that the locating member 60 is being driven into the rafter 18, the locating member is removed and the bracket is moved a short distance transversely with respect to the rafter in a second direction generally opposite the first direction (i.e., away from the first pilot hole 50). When the bracket has been repositioned, the second pilot hole 50 is again used to drive the locating member 60 through the roof sheet. This process is repeated until the second locating member does not contact the rafter. The bracket is now in a position in which the fastening holes 36 are positioned over the fastening zone 26 of the rafter.

After properly positioning the bracket 10, washers 48 may be placed over the grommets 42 positioned within the fastening holes 36. The fasteners 30 are then driven through the grommets 42 and fastening holes 36, through the roof sheet 20 and into the rafter 18 to securely attach the bracket 10 to the roof. Even though the installer cannot see the location of the bracket relative to the rafter 18, the bracket is located so that the fasteners 30 are sufficiently supported within the fastening zone 26 of the rafter. When the roof worker is done with the bracket 10, the fasteners 30 are removed and the holes in the roof sheet 20 and shingles 22 are caulked. The grommets 42, washers 48 and fasteners 30 are replaced and the bracket is inspected for signs of wear.

If no wear is detected on the bracket 10, it is ready to be reinstalled in another location on the roof 14 or on another roof. If the roof worker falls while attached to the bracket 10, the bracket should be replaced due to the high impact loads exerted on the bracket.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of connecting a safety bracket for supporting a fall arrest system to a roof having rafters, shingles and a roof sheet interposed between the rafters and shingles, each rafter having an upper surface comprising a central portion extending along the length of the rafter and defining a fastening zone into which one or more fasteners may be driven to attach the bracket to the roof, and two edge margins on opposite sides of the central portion defining non-fastening zones into which said one or more fasteners should not be driven, each non-fastening zone having a relatively narrow width in a direction transverse to the upper surface of the rafter, the bracket comprising one or more fastening holes for receiving said one or more fasteners for attaching the bracket to one of the rafters and at least two pilot holes for positioning the bracket over the fastening zone of the rafter to prevent said one or more fasteners from being driven into one of the non-fastening zones, said method comprising the steps of:

a) lifting a shingle and sliding the bracket under the shingle and over the roof sheet in the vicinity of one of the rafters;

b) using the first pilot hole to drive the locating member through the roof sheet;

c) if the locating member contacts the rafter when it is driven through the roof sheet, removing the locating member from the roof sheet, moving the bracket in a first direction transverse to the rafter, and repeating step (b);

d) repeating step (c) until the locating member does not contact the rafter when it is driven through the roof sheet;

e) using the second pilot hole to drive a locating member through the roof sheet;

f) if the locating member contacts the rafter when it is driven through the roof sheet, removing the locating member from the roof sheet, moving the bracket transversely with respect to the rafter in a second direction generally opposite said first direction, and repeating step (e);

g) repeating step (f) until the locating member does not contact the rafter when it is driven through the roof sheet; and h) using said one or more fastening holes to drive said one or more fasteners through the roof sheet and into the rafter to securely attach the bracket to the roof.

2. A method as set forth in claim 1 wherein step (h) comprises driving three fasteners through three fastening holes in the bracket.

3. A method as set forth in claim 1 wherein step (h) further comprises driving each fastener through a grommet located within a respective fastening hole.

4. A method as set forth in claim 3 wherein step (h) further comprises placing a steel washer over the grommet prior to driving the fastener through the grommet.

5. A method as set forth in claim 1 further comprising the steps of removing the fastener from the rafter, caulking holes in the roof sheet, replacing the grommet and reinstalling the bracket in a different location using a new fastener.

6. A bracket installed on a rafter of a roof, said bracket being formed for attachment thereto of a safety fall arrest system, said rafter having an upper surface comprising a central portion extending along the length of the rafter and defining a fastening zone into which one or more fasteners may be driven to attach the bracket to the roof, and two edge margins on opposite sides of the central portion defining non-fastening zones into which said one or more fasteners should not be driven, each non-fastening zone having a relatively narrow width in a direction transverse to the upper surface of the rafter, a fastening hole in the bracket, a fastener extending through the fastening hole and into the fastening zone of said rafter thereby fixedly attaching the bracket to the rafter, and at least two pilot holes in the bracket located on opposite sides of the fastening hole, the pilot holes being sized for receiving locating members and positioned with respect to one another and said fastening hole such that the locating members can be inserted into the pilot holes without contacting said rafter.

7. A bracket as set forth in claim 6 wherein each pilot hole is spaced from the fastening hole a distance greater than one half the width of the rafter and less than a distance equal to the width of the rafter minus the width of one of said non-fastening zones of the rafter.

* * * * *